United States Patent [19]

Stewart et al.

[11] 4,083,775

[45] Apr. 11, 1978

[54] BALLAST CLEANER

[75] Inventors: John Kenneth Stewart, Lexington; Helmuth von Beckmann, Columbia, both of S.C.

[73] Assignee: Canron, Inc., New York, N.Y.

[21] Appl. No.: 664,099

[22] Filed: Mar. 5, 1976

[51] Int. Cl.[2] ..... B07B 1/24

[52] U.S. Cl. ..... 209/257; 209/297; 209/421

[58] Field of Search ..... 209/293, 294, 296, 298, 209/284, 297, 288, 299, 257, 421

[56] References Cited

U.S. PATENT DOCUMENTS

| | | | |
|---|---|---|---|
| 289,791 | 12/1883 | Wingard | 209/284 X |
| 911,469 | 2/1909 | Boyd | 209/284 X |
| 964,567 | 7/1910 | Seberg et al. | 209/284 X |
| 3,756,406 | 9/1973 | Khan | 209/294 X |
| 3,941,689 | 3/1976 | Hirayama et al. | 209/296 |
| 3,942,644 | 3/1976 | Vissers | 209/284 X |

*Primary Examiner*—William A. Cuchlinski, Jr.
*Attorney, Agent, or Firm*—Wenderoth, Lind & Ponack

[57] ABSTRACT

A screening device suitable for cleaning railroad ballast which has become fouled with use, and of the type in which ballast to be cleaned is fed into a screen member to separate the coarse or ballast stone from the fines, the stone being reused to ballast the track. A screen member of generally frusto-conical shape, open at each end, is rotatably mounted on a track running frame, with the axis of the screen extending substantially parallel to the track and either horizontal or slightly inclined to the horizontal. The screen member is rotated so that centrifugal action results in the fouled ballast, loaded into the narrower open end of the screen member, moving up the walls thereof to its larger open end. The fines pass through the screen member and the stone is collected at a stone receiving member located adjacent the wide end of the screen member. A generaly frusto-conical fines receiving member of larger diameter than the screen member partially surrounds the screen member and receives the fines which fall therethrough. Conveying members are provided to convey the fines from the fines receiving member to a point of disposal, while the stones received by the stone receiving member are delivered back for re-distribution on the track.

7 Claims, 1 Drawing Figure

BALLAST CLEANER

BACKGROUND OF THE INVENTION

The invention relates to screening devices, and in particular screening devices suitable for ballast cleaning and of the kind which are mounted on track travelling frames and which are utilized to separate the fines from the ballast stones of fouled ballast by means of screens and which redistribute the ballast stones on the track. In known devices of this kind problems have been encountered because of the nature and configuration of the screen, which only utilizes the weight of the fouled ballast to knock the dirt fines through the screen.

It is the object of the present invention to provide a screening device which subjects both the fines and ballast to sufficient force to separate and remove the dirt from the ballast.

SUMMARY OF THE INVENTION

According to the present invention there is provided a screening device, suitable for cleaning railroad ballast, and comprising a frame, a generally frusto-conical screen member open at each end rotatably supported on said frame, means for rotating said screen member about its longitudinal axis, a fines collector, at least partly surrounding said screen member; means for delivering ballast to be cleaned to the narrower open end of said screen member; a stone receiving member located adjacent the wider open end of said screen member; conveying means located adjacent a mouth of said fines collector for removing ballast fines screened through said screen and collected by said fines collector; and, conveying means located adjacent said stone receiving member for removing stones received thereby.

Preferably the fines collector is also of generally frusto-conical shape and is of larger diameter than the screen member. The fines collector may also be provided with means for rotating it and it is preferably driven in a direction opposite to the screen member and at a slower speed than the screen member.

Desirably, helical flutes are provided inside the screen member to guide and promote movement of the ballast material along the inner wall thereof.

Such movement of ballast material may also be controlled by means for tilting the screen member.

DESCRIPTION OF THE DRAWINGS

The following is a description, by way of example only, of embodiments of the present invention, reference being made to the accompanying drawings in which.

DESCRIPTION OF THE SPECIFIC EMBODIMENT

Figure 2:
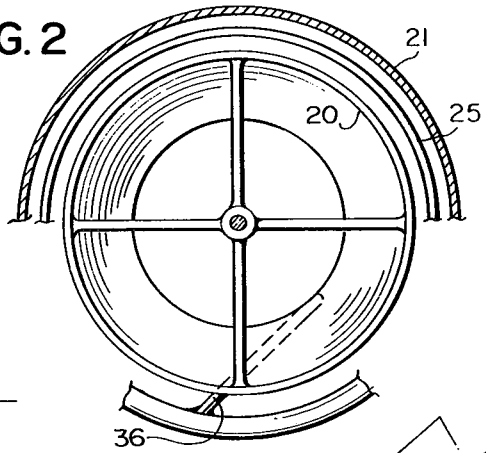
FIG. 2 is an end view of the screening device taken along the line 2—2 in FIG. 1.

Referring to the drawings, a screening device 10 comprises a generally frusto-conical screen member 20 rotatably mounted on a track travelling frame 11 with its longitudinal axis 13 extending substantially parallel to the track 14, and generally horizontal or at a slight inclination thereto as described below. The screen member 20 is mounted on a shaft 15 journaled in bearings 16 and 17 on the frame 11 and is driven by means of a driving motor 18. The screen member 20 may be made of screen material stretched over a frame or, as shown, may be a perforated plate.

Partially surrounding the screen member 20 is a similarly shaped drum defining a fines collector 25 of larger diameter than the screen member 20. The fines collector 25 is mounted in bearings 26, 27 and is driven through a gear train 30 by means of a drive motor 31. The drive motor 31 rotates the fines collector 25 in the opposite direction to, and at a considerably slower speed than, the screen member 20.

A conveyor 32, for conveying ballast to be cleaned from the track to the smaller open end of the screen member 20 is mounted on the frame 11. Adjacent the larger open end of the screen member 20 is a stationary stone receiving housing 21.

A stationary scraper 36 (see also FIG. 2) is mounted between the screen member 20 and the fines collector 25 and scrapes away any fines which may attempt to adhere to the walls of the fines collector 25.

A conveying device 38 for conveying the screened fines to a disposal point is mounted on the frame 11 beneath the mouth of the fines collector 25 and a second conveyor 40 is provided beneath a stationary stone receiving housing 21 for conveying the coarse, or ballast stones, to a point where they may be re-distributed on the track. A separator guide 37 is provided between the conveyor 38 and 40 to ensure separation of the fines and coarse stones.

In operation fouled ballast to be cleaned is scooped, in a manner known per se, onto the ballast delivery conveyor 32 and is fed into the screen member 20 at its narrower open end. The screen member 20 is rotated at a relatively high speed and the fouled ballast is urged against the inner walls of the screen member 20 by centrifugal action. The fines pass through the holes 22 in the wall of the screen member 20 and the coarse ballast is gradually edged forwards along the screen member 20 to the stone receiving housing 21. The fines which fall through the holes 22 of the screen member 20 and are collected in the fines collector 25 are moved downwards by the resultant force created by the rotation of the fines collector 25, to the inside mouth thereof where they fall onto the conveyor 38 and are removed. The stones falling from the stationary stone receiving housing 21 are picked up by the second conveyor 40 and are re-distributed, in known fashion to the track.

A series of helical flute members 37 are provided on the inner surface of the screen member 20 to guide and promote movement of the ballast along the screen member 20.

Figure 3:
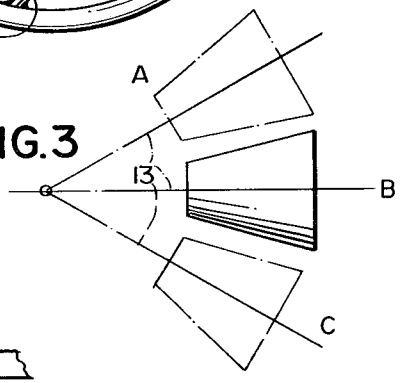
FIG. 3 shows two additional positions of the screening device shown in FIGS. 1 and 2 when tilting means are provided.
Figure 1:
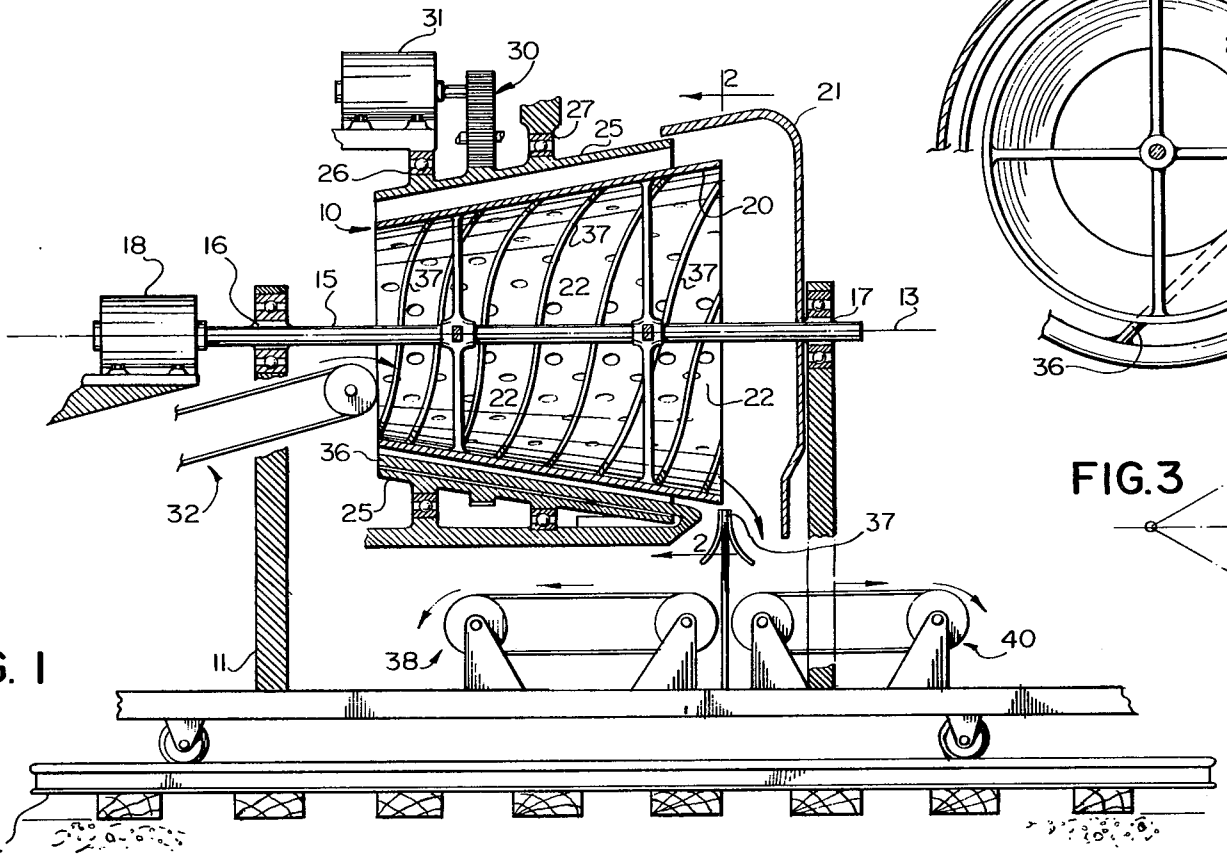
FIG. 1 is a diagrammatic representation, in side section, of a screening device for ballast cleaning.

As shown in FIG. 3, a further embodiment may utilize a tilting means for the screen member 20 in order to increase or decrease the speed of the ballast through the screen member 20, according to the degree of ballast contamination. For example, in position A, the ballast would move along the screen member 20 more slowly than in position B (the ordinary position of the ballast screening device when the longitudinal axis 13 is substantially horizontal). In position C, the angle of elevation of the screen member is decreased thereby allowing the ballast to move more quickly through the device which would provide for more efficient cleaning of lightly contaminated ballast.

It is to be understood that the term frusto-conical as used herein is intended to embrace shapes that approximate to a circular cross-section, for example, an octagonal cross-section.

It will be seen, therefore, that a number of embodiments are possible within the spirit of the invention and its scope should be limited only by the appended claims.

What we claim as our invention is:

1. A screening device suitable for cleaning railroad ballast, and comprising a frame adapted for movement along a railroad right of way; a generally frusto-conical screen member open at each end rotatably supported on said frame; means for rotating said screen member about its longitudinal axis; an imperforate fines collector, at least partially surrounding said screen member; means for rotating said fines collector about a longitudinal axis thereof; means for delivering ballast to be cleaned to the narrow open end of said screen member; a stone receiving member located adjacent the wider open end of said screen member; conveying means located adjacent a mouth of said fines collector for removing ballast fines screened through said screen and collected by said fines collector; and conveying means located adjacent said stone receiving member for removing stones received thereby.

2. A screening device as claimed in claim 1, in which said fines collector is substantially frusto-conical in shape and of larger diameter than said screen member.

3. A screening device, as claimed in claim 1, in which said fines collector is rotated in a direction opposite to said screen member.

4. A screening device, as claimed in claim 1, in which said fines collector is rotated at a slower speed than said screen member.

5. A screening device as claimed in claim 1, in which a series of helical flute members are mounted on the inside of said screen member.

6. A screening device, as claimed in claim 1, in which tilt means are provided to vary the angle of elevation of said longitudinal axis of said screen member.

7. A screening device, suitable for cleaning railroad ballast, and comprising a frame adapted for movement along a railroad right of way; a generally frusto-conical screen member open at each end rotatably supported on said frame; means for rotating said screen member about its longitudinal axis; an imperforate fines collector, at least partially surrounding said screen member; means for rotating said fines collector about a longitudinal axis thereof in a direction opposite to said screen member; means for delivering ballast to be cleaned to the narrower open end of said screen member; a series of helical flute members mounted on the inside of said screen member; a stone receiving member located adjacent the wider open end of said screen member; conveying means located adjacent a mouth of said fines collector for removing ballast fines screened through said screen and collected by said fines collector; conveying means located adjacent said stone receiving member for removing stones received thereby; and tilt means to vary the angle of elevation of said longitudinal axis of said screen member.

* * * * *